US006499398B2

(12) United States Patent
MacNeil

(10) Patent No.: US 6,499,398 B2
(45) Date of Patent: Dec. 31, 2002

(54) HAND STAMP AND A METHOD OF ASSEMBLING HAND STAMP

(75) Inventor: Anthony D. MacNeil, Piscataway, NJ (US)

(73) Assignee: M&R Marking Systems, Inc., Piscataway, NJ (US)

( * ) Notice: Subject to any disclaimer, the term of this patent is extended or adjusted under 35 U.S.C. 154(b) by 0 days.

(21) Appl. No.: 09/971,253

(22) Filed: Oct. 4, 2001

(65) Prior Publication Data

US 2002/0069776 A1 Jun. 13, 2002

Related U.S. Application Data

(60) Provisional application No. 60/237,860, filed on Oct. 4, 2000.

(51) Int. Cl.[7] ..... B41K 1/04; B41K 1/38

(52) U.S. Cl. ..... 101/327; 101/405; 101/368

(58) Field of Search ..... 101/327, 333, 101/334, 405, 406, 103, 104, 109, 368

(56) References Cited

U.S. PATENT DOCUMENTS

| | | | | | |
|---|---|---|---|---|---|
| 3,832,947 | A | * | 9/1974 | Funahashi | 101/125 |
| 3,952,653 | A | * | 4/1976 | McFarland | 101/327 |
| 4,676,162 | A | * | 6/1987 | Phipps et al. | 101/327 |
| 6,047,639 | A | * | 4/2000 | Shih | 101/327 |

* cited by examiner

*Primary Examiner*—Leslie J. Evanisko
(74) *Attorney, Agent, or Firm*—Lerner, David, Littenberg, Krumholz & Mentlik, LLP

(57) ABSTRACT

A hand stamp that preferably includes a case, a platen secured for selective movement within the case, a stamp die retained adjacent to the platen for movement therewith between a non-marking position where the stamp die is remote from a surface to be marked and a marking position where the stamp die is pressed into contact with a surface to be marked; and a retaining member mounted on the platen in any one of a plurality of positions such that the stamp die is secured in an assembled position adjacent the platen is provided. A preferred method of assembling the hand stamp is also provided.

38 Claims, 7 Drawing Sheets

HAND STAMP AND A METHOD OF ASSEMBLING HAND STAMP

This application cites the benefits of the filing date of U.S. Provisional Patent Application No. 60/237,860 filed Oct. 4, 2000, which is incorporated herein by reference.

BACKGROUND OF INVENTION

Several types of hand stamps are available in the commercial market. Most common are self-inking hand stamps and pre-inked hand stamps. Self-inking hand stamps contain an internal source of ink and a mechanism for inking. Thus, self-inking hand stamps include a rather large number of internal parts, and therefore may not be easy to assemble. Great efforts have been expended to develop self-inking hand stamps, which can be quickly and inexpensively assembled. One brand of high quality self-inking hand stamps is sold by M&R Marking System, Inc. of Piscataway, N.J., under the trademark IDEAL. A good example of simplified assembly for self-inking hand stamps is disclosed in U.S. Pat. No. 5,768,992, assigned to M&R Marking System, Inc.

For a variety of applications, mostly due to a smaller number of internal parts, the pre-inked hand stamps are preferable to self-inking hand stamps. Due to the absence of an internal source of ink and inking mechanism and therefore simpler construction, the pre-inked hand stamps may be less expensive and easier to assemble. To insure that a pre-inked hand stamp may create a large number of impressions before a need for re-inking arises, the marking structures of pre-inked hand stamps are made from microporous marking materials, and as such are called microporous marking structures. The microporous marking structures are usually made from suitable polymeric materials or resins (i.e., thermoplastic resins) or other open cell compositions, which include a large quantity of microscopic pores. The multiplicity of such pores allows impregnation of microporous structures with a large quantity of ink. When such microporous marking structures are impregnated with ink and used in hand stamps, thousands of impressions may be created without applying additional ink to the marking structure. The microscopic size of the pores allows the ink to escape at a controlled rate. The marking structure of a pre-inked hand stamp is called the stamp dye.

The stamp dye of a pre-inked hand stamp typically includes a marking surface and a non-marking surface. The marking surface includes raised characters of the image to be created when the hand stamp is pressed against the paper to be marked. When the marking surface of the stamp dye is placed in contact with the paper to be marked, the ink is released at a controlled rate through the surface of the marking structure. The micropores within the raised character are not sealed, allowing the ink to pass through. The pores on the rest of the surface of the stamp dye must be sealed to prevent the release of ink and the distortion of the image.

Several methods of making stamp dyes are known. These methods include for example, syntering, salt leaching and others. Also, stamp dyes may be made from gel material, salt-leached/laser etched rubber or thermal etched foam. One of the preferred methods of making stamp dyes involves cutting the microporous material with a laser. To increase the precision of the cutting process, lasers of higher power are sometimes required. It is known that use of a lower wattage laser may lead to an increase in size error.

A typical pre-inked hand stamp includes a platen, a stamp dye made of a microporous material, a case and a mechanism for moving the stamp dye between marking and non-marking position. The stamp dye is usually secured to the platen and moves along with the platen between a marking and a non-marking position. The non-marking surface of the stamp dye usually lies flat against the platen. The stamp dye has traditionally been secured to the platen by using either a mechanical securing device or an adhesive.

Several drawbacks have been associated with the use of adhesives. For example, the adhesive may work its way through from the non-marking surface of the stamp dye toward the marking surface. There, the adhesive could seal off part of the marking surface, thereby creating ink transfer problems and distorting the image. Problems have also arisen with the use of adhesives because they do not adhere well to wet surfaces. To overcome this problem, the non-marking surface of the stamp dye is typically sealed with a sealant material. The process of applying the sealant material prior to the application of a suitable adhesive can be messy and inconvenient. More importantly, the sealing of the non-marking surface prevents re-inking of the stamp dye from the rear, i.e., from the side of the non-marking surface.

Even with the large ink capacity of modern microporous materials, the stamp dye eventually runs out of ink. It is preferable to re-ink the stamp dye from the rear, i.e., from the side of the non-marking surface, because the marking surface pre-inking is messy and necessitates a temporary suspension in the use of the hand stamp. However, when the non-marking surface is sealed to allow the use of adhesive, the re-inking from the rear is impossible since the sealant closes the pores, inhibiting the absorption of ink.

The use of mechanical securing procedures does not require the use of a sealant, and thus allows re-inking from the rear. However, the use of the mechanical securing devices has also been, to date, associated with some drawbacks. The mechanical securing device is typically a ring or a ledge, which holds the edges of the marking surface of the stamp dye in the assembled position on the platen. In the prior art hand stamps, a mechanical securing device, e.g., a ring or a ledge, is usually locked on the platen in a single locking position. When the ledge is locked, the distance between the ledge and the platen is fixed and cannot be adjusted. However, the thickness of stamp dies to be used with the hand stamp varies, for example as a function of the cutting error. Therefore, some stamp dies will be held tightly, whereas others will not. To address this drawback, the majority of commercially available pre-inked hand stamps, which utilize the mechanical securing devices, commonly use additional shims to properly fit the stamp dye between the platen and the mechanical securing device. Whether the ring or the ledge fits inside the platen or outside the platen, the prior art pre-inked hand stamps usually use such shims. The use of shims leads to additional steps in the assembling process, as well as the increase in cost for the shims themselves. Also, shims may somewhat inhibit re-inking from the rear.

Therefore, there is a need for an improved pre-inked hand stamp that allows securing a stamp dye in an infinite number of positions within a desired range.

SUMMARY OF THE INVENTION

The present invention addresses this need by providing a hand stamp that allows the use of stamp dyes of various thicknesses, as well as a method of assembling such hand stamps.

In accordance with one aspect of the present invention, a hand stamp is provided which includes a case, a platen secured for movement within the case, a stamp dye which is retained adjacent to the platen, allowing the movement of the stamp dye together with the platen between a non-marking position and a marking position, and a retaining member which may be mounted on the platen in any one of a plurality of positions. In an assembled position, the stamp dye is secured adjacent to the platen. Preferably, the retaining member is directly mounted on the platen. Preferably, the retaining member is mounted in such a way that it may assume any one of an infinite number of positions between a lowermost position, where the retaining member is furthermost from the platen, and an uppermost position where it is closest to the platen. By assuming a position which corresponds to the thickness of the particular stamp dye, the hand stamp may accommodate stamp dyes of various thicknesses.

In a preferred embodiment of the present invention, the platen includes a substantially plain button surface, a top surface and a perimeter. The retaining member includes a frame, which defines an interior opening. The stamp dye, having a marking surface and a non-marking surface, is positioned with the non-marking surface adjacent to the bottom surface of the platen, and the marking surface extending through the interior opening. The interior opening allows the marking surface of the stamp dye to reach the surface to be marked.

The hand stamp of the present invention also includes one or more clips for securing the retaining member to the platen by friction. The clips extend in a direction substantially perpendicular to the bottom surface of the platen and may be part of and integral with the retaining member. The frame of the retaining member includes a ledge and a sidewall, which are integral and substantially perpendicular to each other. The ledge extends into the interior opening in the plane parallel to the bottom surface of the platen. In the assembled hand stamp, the non-marking surface of the stamp dye lies flat against the bottom surface of the platen, and the marking surface of the stamp dye and the perimeter of the marking surface of the stamp dye is arranged flat against and adjacent to the ledge.

The clips for securing the retaining member on the platen by friction fit may include a pair of flexible and resilient fingers. The fingers may extend upwardly from and be integral with the sidewall of the retaining member. The fingers are constructed in an arrangement having a broad part and a narrow part, wherein they are capable of moving toward each other so that the broad part becomes narrower. In the most preferred embodiment, the arrangement has a form of letter "V".

The platen may include a platenwall, which defines the perimeter of the platen and extends in a direction substantially perpendicular to the bottom surface of the platen. When the stamp dye is inside the assembled hand stamp, it is enclosed by the platenwall. The platenwall may include one or more grooves having a width adapted for receiving the fingers of the retaining member. The grooves extend in a direction substantially perpendicular to the bottom surface of the platen. When the fingers of the retaining member are in inserted into the grooves of the platen, they are flexed toward each other and thus exert pressure in the direction opposite to the direction of their flexing, allowing the retaining member to be mounted on the platen in friction-fit arrangement.

The hand stamp according to an embodiment of the present invention may also include openings through the top and bottom surfaces of the platen for supplying ink to the stamp dye. The hand stamp may also include a handle and a shaft arranged within the case and being connected between the platen and the handle, as well as a spring for biasing the platen in the non-marking position.

In accordance with another aspect of the present invention, a part for a hand stamp is provided. The part is designed for holding a stamp dye in the assembled hand stamp. The part for hand stamp includes a platen and a retaining member mounted on the platen in any one of a plurality of positions such that a stamp dye is secured within the part adjacent to the platen.

According to an embodiment of the present invention, the retaining member may be mounted on the platen in any one of an infinite number of positions between the lowermost position and an uppermost position, whereby, upon final assembly of the hand stamp, stamp dyes of various thicknesses may be tightly secured between the platen and the retaining member by assuming the final assembled position which corresponds to the thickness of the stamp dye. The part for a hand stamp according to the present invention may also include one or more clips for mounting the retaining member on the platen in friction fit arrangement. The clips may extend vertically between the retaining member and the platen and may be part of the retaining member. The clips may also be integral with the retaining member. It is important to appreciate that other arrangements of the retaining member and the platen are possible. For example, the clips may extend from the platen or be integral with the platen. In such a case, the retaining member would include the grooves for friction fit mounting. Also, the clips may be independent from both the platen and the retaining member. One skilled in the art appreciates that all of these arrangements are within the scope of the invention.

The part for a hand stamp may include a substantially planar bottom surface, a top surface and a perimeter. The retaining member may include a frame defining an interior opening, with the frame including a ledge and a sidewall integral and substantially perpendicular to each other. The ledge may extend into the interior opening narrowing the interior opening and lie in a plane substantially parallel to the bottom surface of the platen. The part for a hand stamps according to the present invention may also include one or more clips extending in the direction substantially perpendicular to the bottom surface of the platen. The clips may include a pair of flexible and resilient fingers in an arrangement having a broad part and a narrow part. The fingers could be capable of moving toward each other to narrow the broad part. The arrangement may have a forum of letter V. Preferably, the clips extend operably from and integral with the side wall of the retaining member, with the broad part of the arrangement directed toward the platen. The platen may include a platenwall defining the perimeter of the platen and integral therewith. Preferably, the platenwall extends downward in a direction substantially perpendicular to the bottom surface of the platen. In the assembled hand stamp, the platenwall encloses a stamp dye placed therein.

To receive the fingers of the retaining member, the platen wall has one or more grooves extending in the direction substantially perpendicular to the bottom surface of the platen. When fingers are engaged in the grooves, they are flexed toward each other exerting pressure in the direction opposite the direction of their flexing, allowing the retaining member to be mounted on the platen by a friction feed mechanism. In a particularly preferred embodiment, the platen and the retaining member are rectangular, and the retaining member includes four clips. The retaining member is produced from a resilient and flexible material, preferably an appropriate plastic.

According to yet another aspect of the present invention, the method of assembling a part of hand stamp comprising a retaining member, a platen and stamp dye is provided, the method including the steps of placing the stamp dye within the retaining member so that the perimeter of the stamp dye is enclosed by the perimeter of the retaining member, arranging the platen of the retaining member so that the perimeter of the platens surrounds the perimeter of the retaining member, and applying a force to the platen to create a sufficient friction fit with respect to the retaining member, whereby the stamp dye is secured in the assembled position within the platen and the retaining member. Preferably, in this method of assembling a part of a hand stamp, the retaining member includes a frame defining interior opening and with the frame including a ledge and sidewall integral and substantially perpendicular to each other, the ledge extending and then narrowing the interior opening. Most preferably, the platen includes a substantially planar bottom surface and a top surface. In the most preferred embodiment, the platen is placed over the retaining member with the ledge being substantially parallel to the bottom surface of the platen. The most preferable embodiment includes assembling the part for the hand stamp described above.

DETAILED DESCRIPTION

As shown above, the prior art methods of attaching a mechanical securing device, i.e., a ring or a ledge, to the platen has suffered from the same drawback: the necessity to insert shims to compensate for different thicknesses of stamp dyes. The present invention overcomes this drawback by providing a hand stamp wherein the mechanical securing device may be mounted on the platen in a plurality of positions, instead of locking the mechanical securing device on the platen in a single position, as taught by prior art.

Figure 1:
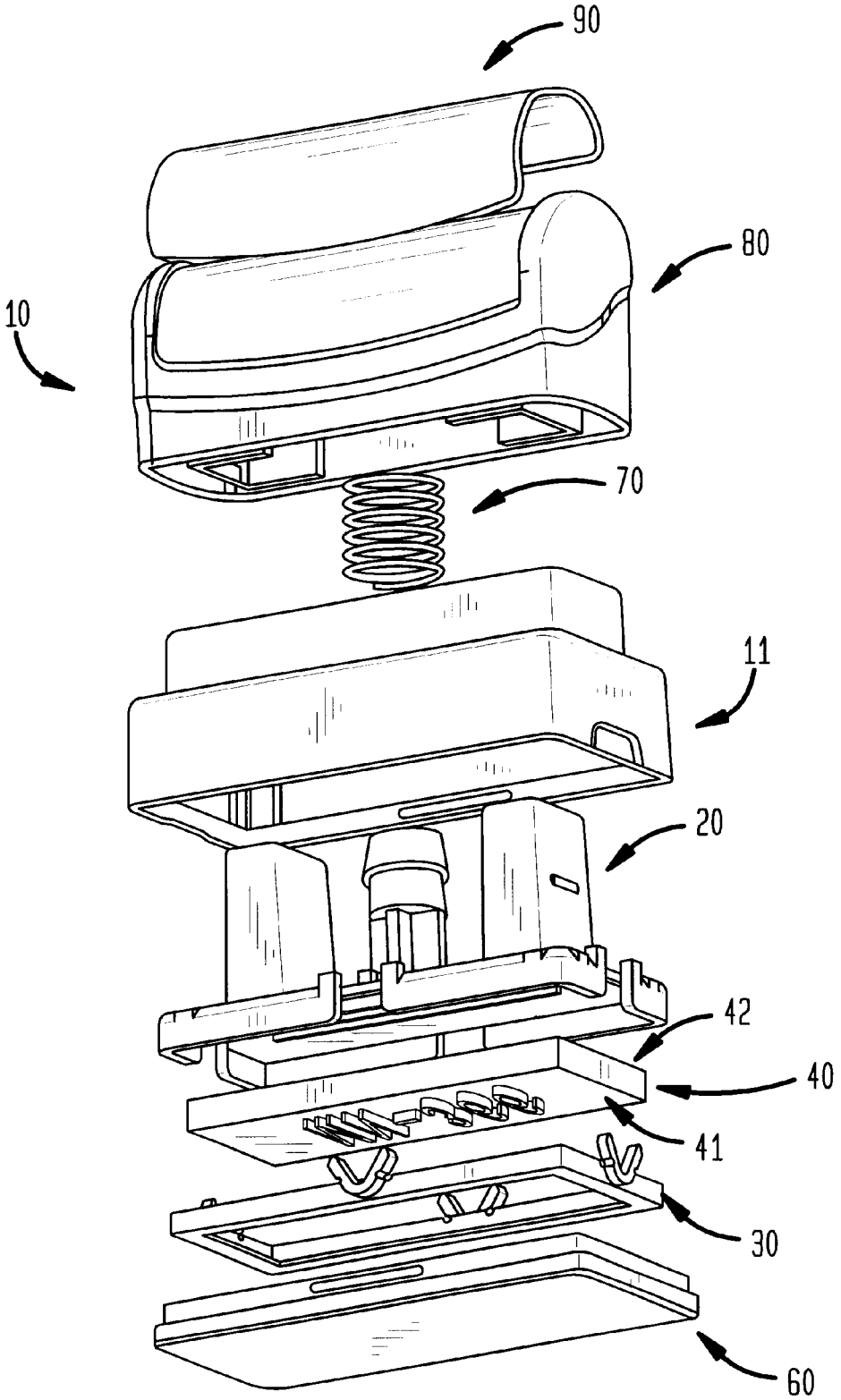
FIG. 1 is an exploded view of a hand stamp in accordance with an embodiment of the present invention.

A number of pre-inked hand stamps may be used in accordance with the present invention. One example of a completed hand stamp design is the embodiment shown in FIG. 1, and designated by the reference numeral 10. It should be understood that various other embodiments of hand stamps may be used with the novel features of the present invention and thus, hand stamp 10 of FIG. 1 is intended only by way of illustration.

The hand stamp 10 includes four major parts: a case 11, a platen 20, a retaining member 30 and a stamp dye 40. The hand stamp 10 also includes a cover 60, a spring 70, a handle 80 and a lens 90.

Figure 2:
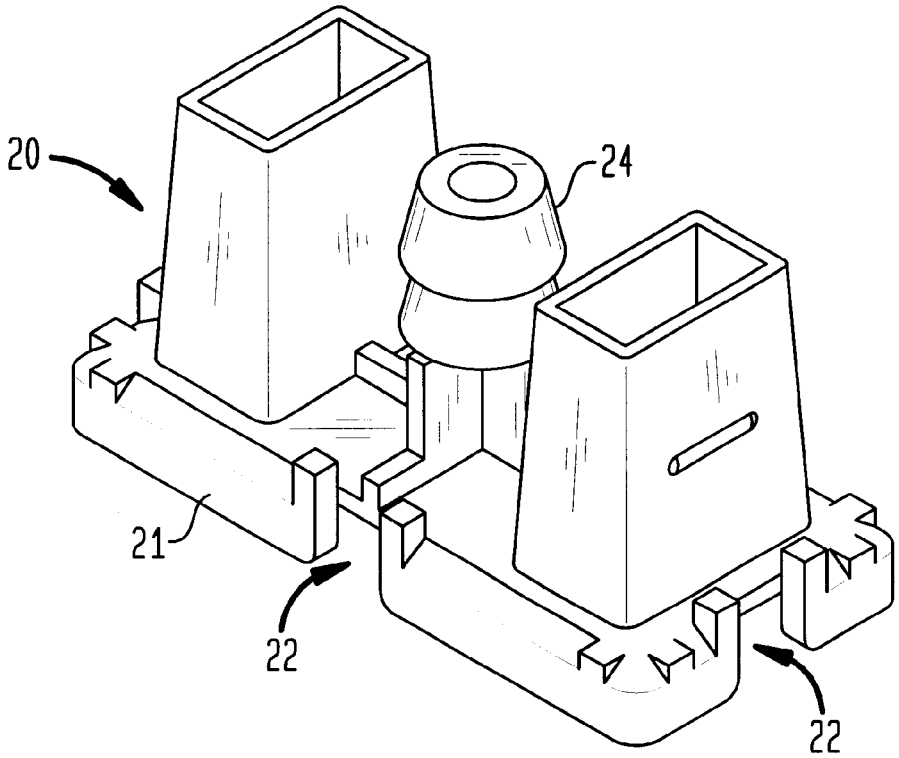
FIG. 2 is an elevated side view of a platen for the hand stamp in accordance with the embodiment of the present invention.
Figure 3:
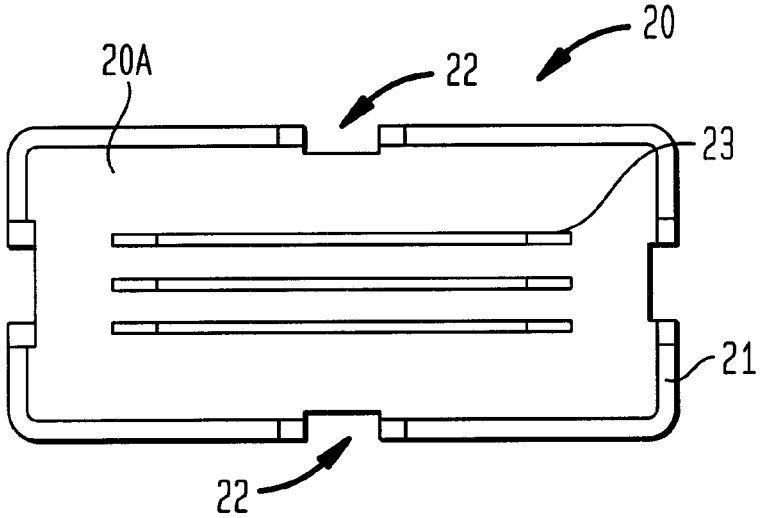
FIG. 3 is a bottom view of the platen.
Figure 4:
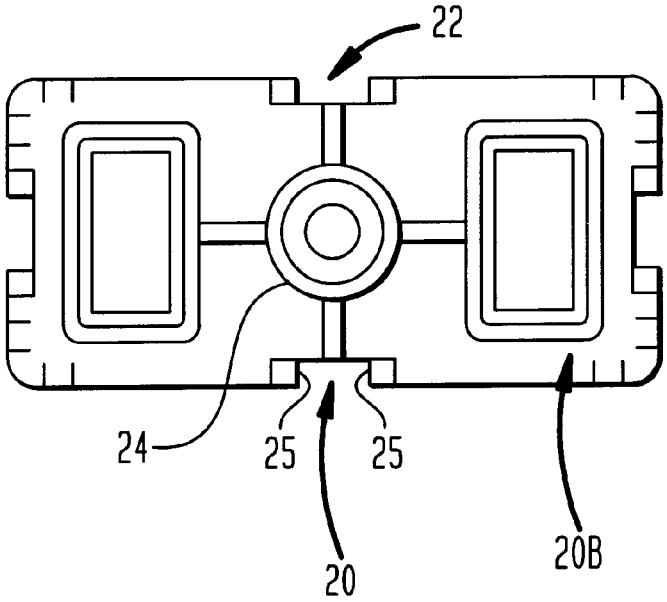
FIG. 4 is a top view of the platen.

The platen 20 is shown in FIGS. 2–4. It includes a substantially planar bottom or inside surface 20*a* and a top surface 20*b*. The bottom surface 20*a* is surrounded by a platenwall 21. The platen wall 21 has four grooves 22 extending in a direction perpendicular to the bottom surface 20*a* of the platen 20. Each of the grooves 22 has side walls 25. As shown in FIG. 3, the platen 20 may also include one or more openings 23 extending through both top surface 20*b* and bottom surface 20*a* of the platen 20, as well as a shaft 24, for connecting the platen 20 with the case 11. The openings 23 are designed for re-inking the stamp dye 40.

Figure 5:
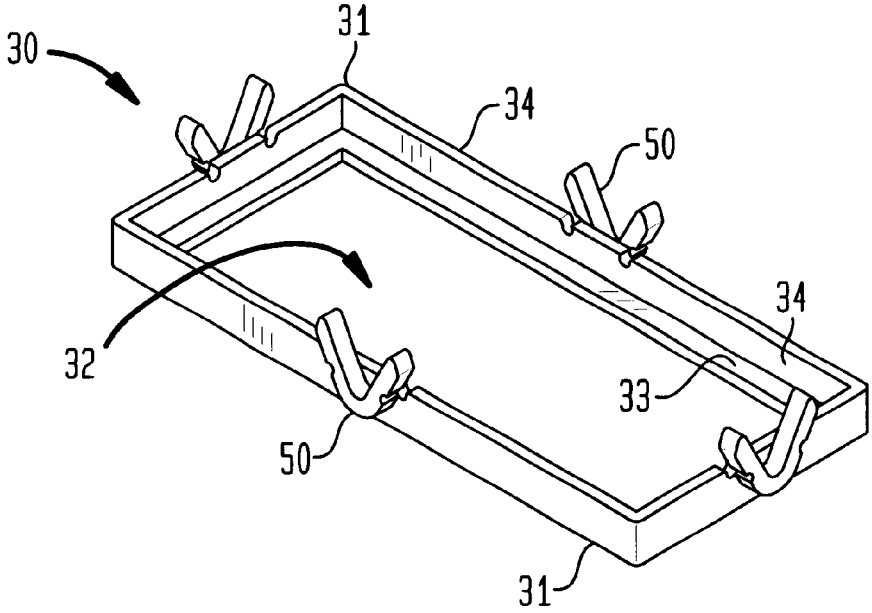
FIG. 5 is an elevated side view of a retaining member for the hand stamp in accordance with the embodiment of the present invention.
Figure 6:
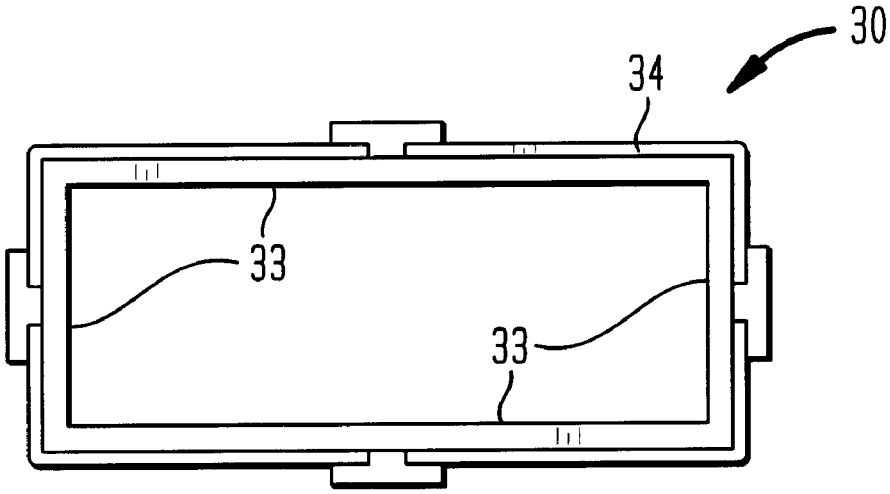
FIG. 6 is a top view of the retaining member.

The retaining member 30 is shown in FIGS. 5–6. As can be seen from FIG. 5, the retaining member 30 includes a frame 31 defining an interior opening 32. FIG. 6 shows that the frame 31 includes a ledge 33, extending into the interior opening 32. The frame 31 also includes a sidewall 34, lying substantially perpendicular to the ledge 33. The ledge 33 secures the stamp dye 40 within the hand stamp 10. The ledge 33 extends into and narrows the interior opening 32.

Figure 7:
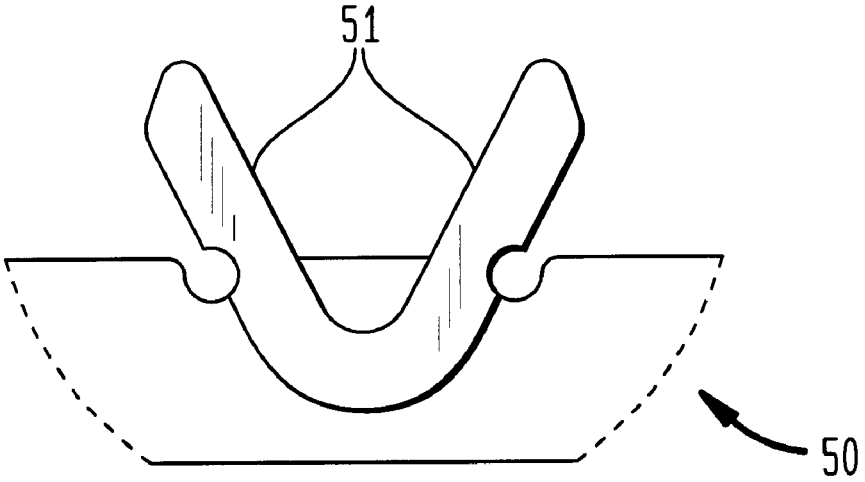
FIG. 7 is a front view of a clip for the hand stamp in accordance with the embodiment of the present invention.

As seen in FIGS. 6–7, the retaining member 30 also includes one or more clips 50 for mounting the retaining member 30 onto the platen 20 in friction-fit arrangement. For the hand stamp 10, the clips 50 are integral with and extend from the sidewall 34 of the retaining member 30. Clips 50 are substantially perpendicular to the ledge.

In the embodiment of the invention described herein, each of the clips 50 includes two flexible and resilient fingers 51, which are capable of moving toward each other. The fingers 51 are constructed in an arrangement which has a broad part and a narrow part. In the most preferred embodiment, the arrangement has a form of the letter "V". It must be appreciated that numerous alternative designs for clips 50 are possible without deviating from the novel features of this invention, i.e., mounting the mechanical securing device onto the platen by friction.

An example of the stamp dye 40 may be seen in FIG. 1. The stamp dye 40 has a marking surface 41 and a non-marking surface 42. The distance between these two surfaces is the thickness of the stamp dye.

In the assembled hand stamp 10, the non-marking surface 42 of the stamp dye 40 lies flat against and adjacent with the bottom surface 20*a* of the platen 20. The perimeter of the marking surface 41 of the stamp dye 40 lies flat against and adjacent to the ledge 33. When the platen 20 is in the marking position, the raised characters on the marking surface 41 of the stamp dye 40 extend through the interior opening 32, whereas the ledge 33 covers the perimeter of the marking surface 41. The perimeter of the marking surface 41 of the stamp dye 40 does not have characters to be impressed on the surface to the marked.

Figure 8:
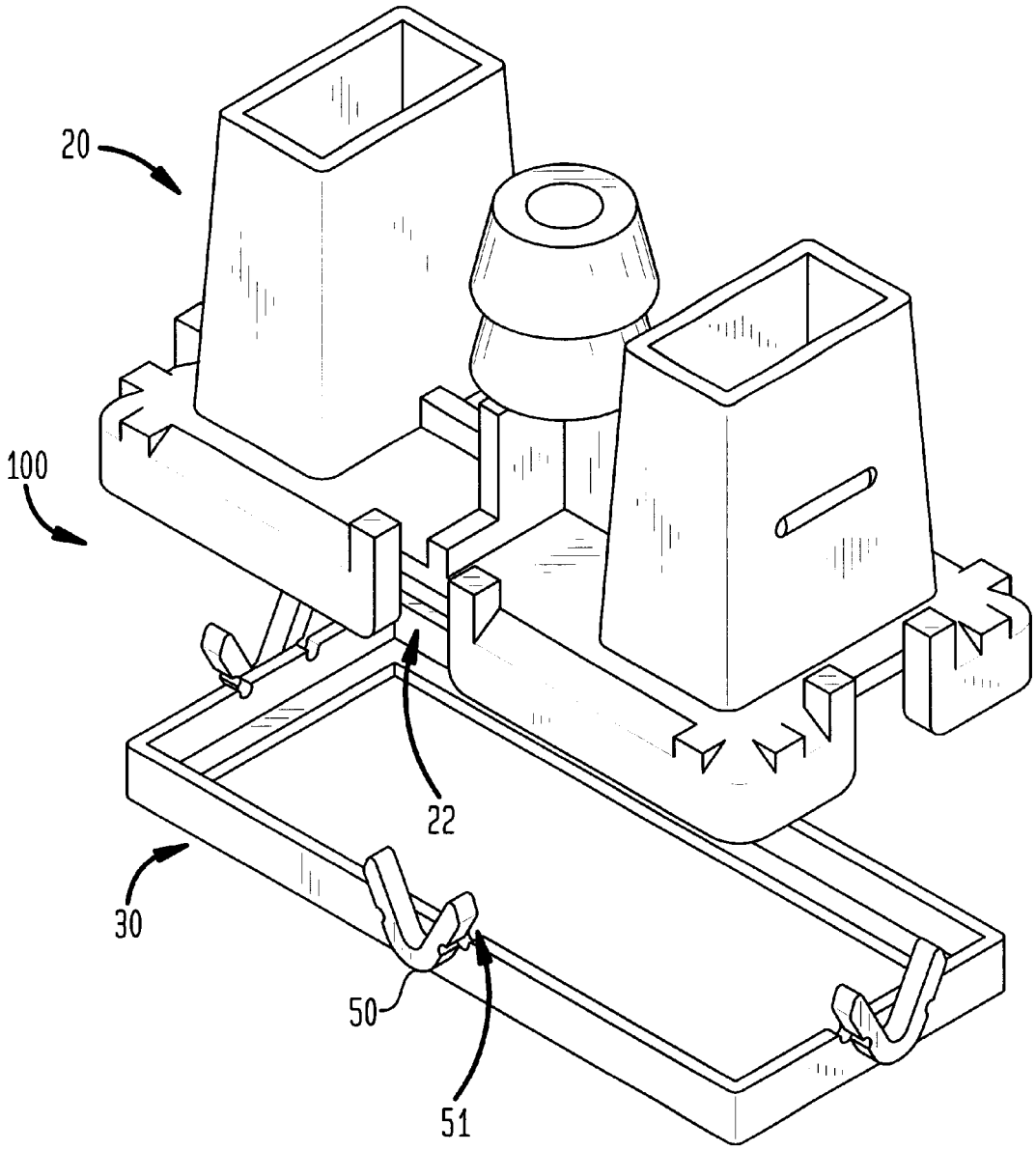
FIGS. 8–10 are illustrations of assembly of a part for a hand stamp in accordance with an embodiment of the present invention.

FIG. 8 illustrates the positions of the platen 20 and the retaining member 30 before the hand stamp 10 is assembled. The fingers 51 are positioned against the grooves 22 of the platen 20. The width of the grooves 22 is adopted for receiving the fingers 51 by being slightly smaller than the broad part of the arrangement of the fingers 51, as the same time allowing the fingers 51 to be inserted. When the fingers 51 are inserted into the grooves, fingers 51 flex toward each other, exerting pressure in the direction opposite to the direction of their flexing and creating friction between the fingers and the side walls 25 of the grooves 22. The fingers 51 will exert pressure on the side walls 25 of the grooves 22 regardless of the position of the retaining member 30 with respect to the bottom surface 20*a* of the platen 20. Thus, the position of the retaining member may be adjusted as a function of the thickness of the stamp dye 40. For example, when the retaining member 30 is mounted in the position shown in FIG. 9, the hand stamp 10 may accommodate a thicker stamp dye than in the position shown in FIG. 10.

In another aspect of the present invention, a part for a hand stamp 100 is provided that includes a platen and a retaining member mounted on the platen in any one of a variety of positions. One of the embodiments is the part shown in FIGS. 8–10 and designated by reference numeral 100. It includes the platen 20 and the retaining member 30, constructed and cooperating as described above with respect to the hand stamp 10.

Figure 9:
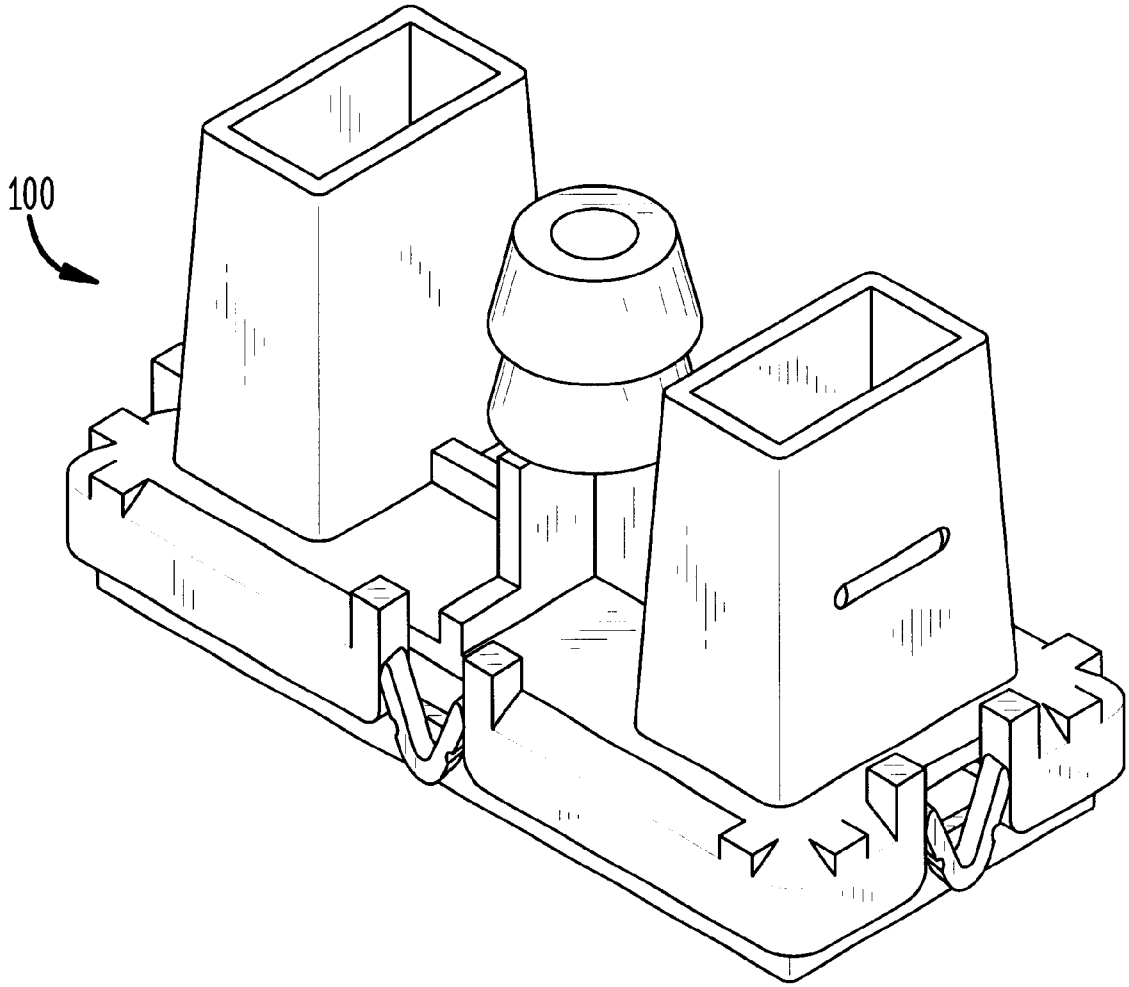
Figure 10:
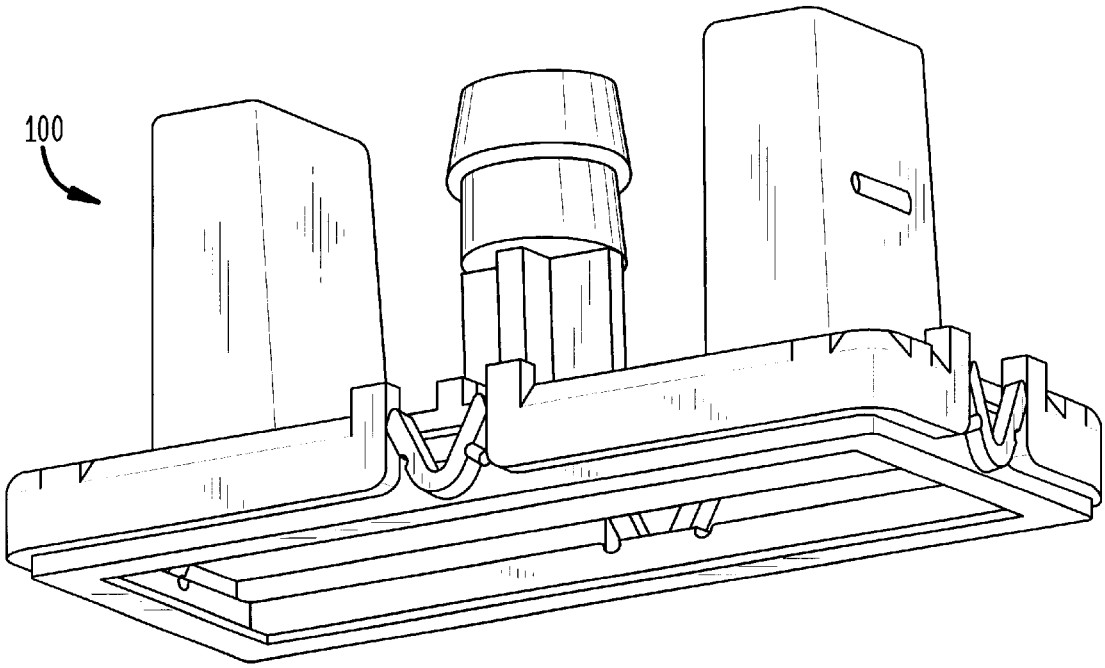

The present invention also provides a simplified method of assembly for pre-inked hand stamps. For the purpose of illustration, this method will be shown with respect to the hand stamp 10, and illustrated with reference to FIGS. 8–10. To assemble the hand stamp 10, the retaining member 30 is placed on a work surface and the stamp dye 40 is inserted thereon, with the perimeter of the marking surface 41 of the stamp dye 40 lying flat against and adjacent to the ledge 33 of the retaining member 30. The platen 20 is placed over the retaining member 30. In such a position, shown without a stamp dye in FIG. 8, the grooves 22 of the platen 20 are opposite to the fingers 50 of the retaining member 30. Then, a force is applied to the platen 20, and fingers 51 become engaged in the grooves 22, as described above. (See FIGS. 9–10, shown without stamp dye). The distance between the bottom surface 20*a* of the platen 20 and the ledge 33 of the retaining member 30 will correspond to the thickness of the particular stamp dye 40.

It should be understood that this method of assembly may be used with hand stamps other than the hand stamp 10, as well as that the order of steps and specific arrangements may vary. For example, the platen 20 may be placed on a work surface first.

One skilled in the art would understand that the novel feature of this invention may be used not on the preferred embodiment disclosed herein but also with a wide variety of pre-inked hand stamps, and the precise arrangement and form of the parts may vary without varying the novel features of the invention.

The present invention provides a number of advantages over the existing pre-inked hand stamps. The principal advantage is the ability to use a mechanical security device with pre-inked hand stamps without the use of shims, the simplification of the assembly and the related drop in the expenses. As shown above, the use of the mechanical securing devices allows re-inking from the rear of the stamp dye. Since the retaining member may be mounted onto the platen in a variety of positions, stamp dyes of various thicknesses may be accommodated tightly between the retaining member and the platen. Thus, shims are not necessary.

Another important advantage is the lower standards for manufacturing tolerances with respect to the thickness of the stamp dye. Since the hand stamps and the part for a hand stamp according to the present invention may accommodate stamp dyes of various thicknesses, the precision of cutting of the microporous material may be somewhat lessened. This leads to an improvement in the manufacturers' ability to use a lower wattage laser and therefore to use less time in cutting since less material needs to be removed. With the existing hand stamps, higher precision and therefore higher wattage lasers were required. For the same reason, the present invention allows versatility in dye selection since the requirements for precision in dye cutting are lower.

Another advantage of the present invention is that the required character height on the marking surface of a stamp dye is substantially less than with the prior art pre-inked hand stamps utilizing mechanical securing devices. As shown, in the existing hand stamps, a ring or ledge is mounted onto a platen by locking the mechanical securing device in place. In contrast, in the hand stamps of the present invention, the retaining member is not locked onto the platen but only secured therein. Thus, the compressibility of the retaining member is higher. For example, the flexible and resilient fingers 51 of the retaining member 30 may be flexed within the grooves 22 of the platen 20, thus allowing the hand stamp 10 to be compressed against the surface to be marked to a higher degree than the prior art hand stamps, which utilize locking of the mechanical securing device. Thus, the required character height is less.

Finally, another advantage of the present invention is the ease of assembly. The assembly of pre-inked hand stamps of the present invention does not require insertion of shims, as the prior art. This eliminates one of the steps of the prior art assembly processes.

It should be appreciated that various modifications to the hand stamp is closed herein and the steps of assembling the present hand stamps can be made in the description set forth herein or remaining within the scope of the present invention. Indeed such modifications are encouraged to be made in the features of the disclosed hand stamps and the steps and the method are remaining within the scope of the claims set forth below.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A hand stamp comprising a) a case;

b) a platen secured for selective movement within said case;

c) a stamp die retained adjacent to said platen for movement therewith between a non-marking position where said stamp die is remote from a surface to be marked and a marking position where said stamp die is pressed into contact with the surface to be marked; and d) a retaining member mountable on said platen in a plurality of positions, said retaining member mounted on said platen in one of said plurality of positions so that said retaining member securely holds said stamp die adjacent said platen.

2. The hand stamp of claim 1, wherein said retaining member is directly mounted on said platen.

3. The hand stamp of claim 1, further comprising a handle.

4. The hand stamp of claim 1, wherein said plurality of positions includes an infinite number of positions between a lowermost position and an uppermost position, whereby said hand stamp can accommodate stamp dies of various thicknesses.

5. The hand stamp of claim 4, wherein said platen comprises a substantially planar bottom surface, a top surface and a perimeter; said retaining member comprising a frame defining an interior opening; said stamp die having a non-marking surface and a marking surface, said non-marking surface being retained adjacent to said bottom surface of said platen.

6. The hand stamp of claim 5, further comprising at least one clip constructed and arranged to secure said retaining member to said platen by friction, said at least one clip extending in a direction substantially perpendicular to said bottom surface of said platen.

7. The hand stamp of claim 6, wherein said at least one clip forms part of and is integral with said retaining member.

8. The hand stamp of claim 7, wherein said frame comprises a ledge and a sidewall integral with and substantially perpendicular to said ledge, said ledge extending into said interior opening, said ledge lying in a plane substantially parallel to said bottom surface of said platen.

9. The hand stamp of claim 8, wherein said marking surface of said stamp die has a perimeter and is arranged flat against and adjacent to said ledge.

10. The hand stamp of claim 9, wherein said at least one clip comprises a pair of flexible and resilient fingers.

11. The hand stamp of claim 10, wherein said at least one clip extends upwardly from and is integral with said sidewall of said frame of said retaining member.

12. The hand stamp of claim 11, wherein said platen comprises a platenwall, defining the perimeter of said platen, said platenwall extending in a direction substantially perpendicular to said bottom surface of said platen, said stamp die being enclosed by said platenwall.

13. The hand stamp of claim 12, wherein said platenwall has at least one groove having a width adopted for receiving said fingers, said groove extending in a direction substantially perpendicular to said bottom surface of said platen, said fingers engaged in said groove whereby said fingers are flexed toward each other to exert pressure in a direction opposite to the direction of their flexing, whereby said retaining member is mounted on said platen in a friction-fit arrangement.

14. The hand stamp of claim 13, further comprising a spring for biasing said platen into said non-marking position, said platen being adopted for reciprocal movement within said case.

15. The hand stamp of claim 1, further comprising at least one opening through said platen for supplying ink to said stamp die.

16. The hand stamp of claim 3, further comprising a shaft arranged within said case and being connected between said platen and said handle.

17. A part for a hand stamp, said part adopted for holding a stamp die in the assembled hand stamp, said part for a hand stamp comprising a) a platen, and b) a retaining member mountable on said platen in a plurality of positions, said retaining member being mounted on said platen in one of said plurality of positions in the assembled hand stamp so that said retaining member securely holds a stamp die adjacent said platen.

18. The part for a hand stamp of claim 17, wherein said plurality of positions includes an infinite number of positions between a lowermost position and an uppermost position, whereby, in the assembled hand stamp, said retaining member tightly secures a stamp die between said platen and said retaining member by assuming a final assembled position corresponding to a thickness of a stamp die.

19. The part for a hand stamp of claim 17, further comprising at least one clip for mounting said retaining member on said platen by friction-fit mechanism, said at least one clip extending vertically between said retaining member and said platen.

20. The part for a hand stamp of claim 19, wherein said at least one clip is part of said retaining member.

21. The part for a hand stamp of claim 20, wherein said at least one clip is integral with said retaining member.

22. The part for a hand stamp of claim 21, wherein said platen comprises a substantially planar bottom surface, a top surface and a perimeter; said retaining member comprising a frame defining an interior opening; whereby a stamp die may extend through said interior opening.

23. The part for a hand stamp of claim 22, wherein said frame comprises a ledge and a side wall integral with and substantially perpendicular to said ledge, said ledge extending into and narrowing the interior opening, said ledge lying in a plane substantially parallel to said bottom surface of said platen.

24. The part for a hand stamp of claim 23, wherein said at least one clip extends in a direction substantially perpendicular to said bottom surface of said platen.

25. The part for a hand stamp of claim 24, wherein said at least one clip comprises a pair of flexible and resilient fingers in an arrangement having a broad part and a narrow part, said fingers capable of moving toward each other thereby the broad part becomes more narrow.

26. The part for a hand stamp of claim 25, wherein said arrangement has a form of a letter "V".

27. The part for a hand stamp of claim 26, wherein said at least one clip extends upwardly from and is integral with said side wall of said retaining member, with said broad part being directed toward the platen.

28. The part for a hand stamp of claim 27, wherein said platen comprises a platenwall, said platenwall defining the perimeter of the platen and is integral therewith, said platenwall extending downwards in a direction substantially perpendicular to the bottom surface of the platen, whereby a stamp die is enclosed by said platenwall when placed into the part for a hand stamp.

29. The part for a hand stamp of claim 28, wherein said platenwall has at least one groove having a width adopted for receiving said fingers, said at least one groove extending in a direction substantially perpendicular to the bottom surface of the platen, said fingers engaged in said at least one groove thereby said fingers are flexed toward each other thereby exerting pressure in a direction opposite to the direction of their flexing, whereby said retaining member is mounted on said platen in a friction-fit arrangement.

30. The part for a hand stamp of claim 29, wherein said retaining member comprises four clips.

31. The part for a hand stamp of claim 29, wherein said platen and said retaining member are substantially rectangular.

32. The part for a hand stamp of claim 29, wherein said retaining member is produced from a resilient and flexible material.

33. The part for a hand stamp of claim 32, wherein said material is plastic.

34. A method of assembling a part of a hand stamp comprising a retaining member, a platen and a stamp die, said method comprising the steps of:

a) placing the stamp die within the retaining member so that the perimeter of said stamp die is enclosed by the perimeter of the retaining member;

b) arranging the platen over the retaining member so that the perimeter of the platen surrounds the perimeter of the retaining member; and c) applying a force to the platen to create a sufficient friction fit with respect to the retaining member, whereby said stamp die is secured in an assembled position between said platen and said retaining member.

35. The method of claim 34, wherein said retaining member comprises a frame defining an interior opening, said frame comprising a ledge and a side wall integral with and substantially perpendicular to said ledge, said ledge extending into and narrowing the interior opening, said side wall extending vertically upwards; said platen having a substantially planar bottom surface and a top surface.

36. The method of claim 35, wherein said platen is placed over said retaining member with the ledge being substantially parallel to the bottom surface of said platen.

37. The method of claim 36, said retaining member further comprising at least one clip for securing said retaining member on said platen, said at least one clip extending vertically upwards in a direction substantially perpendicular to said ledge, said at least one clip extending from and integral with the side wall of said retaining member; said at least one clip comprising a pair of flexible and resilient fingers in an arrangement having a broad part and a narrow part, said fingers capable of moving toward each other thereby the broad part becomes more narrow, said broad part is directed toward the platen; said platen comprising a platenwall, said platenwall defining the perimeter of the platen and being integral therewith, said platenwall extending downwards in a direction substantially perpendicular to the plate, said stamp die enclosed by said platenwall after the hand stamp is assembled; said platenwall having at least one groove having a width adopted for receiving said fingers, said at least one groove extending in a direction substantially perpendicular to the bottom surface of the platen.

38. The method of claim 37, wherein said step of applying force comprises said fingers engaging into said grooves thereby the fingers are flexing toward each other, exerting pressure in a direction opposite to the direction of their flexing, whereby said retaining member is secured on said platen by a friction-fit mechanism.

* * * * *